US008611810B2

(12) United States Patent
Walley et al.

(10) Patent No.: US 8,611,810 B2
(45) Date of Patent: Dec. 17, 2013

(54) METHOD AND SYSTEM FOR INTEGRATED FM RECORDING

(75) Inventors: John Walley, Ladera Ranch, CA (US); Evan McCarthy, Costa Mesa, CA (US)

(73) Assignee: Broadcom Corporation, Irvine, CA (US)

( * ) Notice: Subject to any disclaimer, the term of this patent is extended or adjusted under 35 U.S.C. 154(b) by 754 days.

(21) Appl. No.: 12/055,809

(22) Filed: Mar. 26, 2008

(65) Prior Publication Data

US 2009/0247096 A1 Oct. 1, 2009

(51) Int. Cl.
*H04H 40/00* (2008.01)

(52) U.S. Cl.
USPC ..... 455/3.06; 455/3.01; 455/3.04

(58) Field of Classification Search
USPC ..... 455/3.01–3.06, 184.1, 185.1; 375/316
See application file for complete search history.

(56) References Cited

U.S. PATENT DOCUMENTS 7,502,589 B2 * 3/2009 Howard et al. ..... 455/3.06
2001/0048677 A1 * 12/2001 Boys ..... 370/352
2006/0059090 A1 * 3/2006 Lahtinen et al. ..... 705/50
2007/0238427 A1 * 10/2007 Kraft et al. ..... 455/184.1
2007/0293169 A1 * 12/2007 Maggio ..... 455/152.1
2008/0152039 A1 * 6/2008 Shah et al. ..... 375/316

* cited by examiner

*Primary Examiner* — Raymond Dean
(74) *Attorney, Agent, or Firm* — Thomas | Horstemeyer, LLP

(57) ABSTRACT

Aspects of a method and system for integrated FM recording are provided. A multimedia device with various integrated systems such as an integrated FM radio may provide content-based multimedia content recording, recorded content retrieval, and playback of desired or potentially relevant contents. The multimedia device may receive multimedia content along with information identifying the received multimedia content via the various integrated systems. A segment of the received multimedia content may be recorded selectively by comparing the corresponding content information with a favorite content list. The favorite content list may be generated and updated based on the multimedia content and/or program selection data. The multimedia device may have access to additional related stored multimedia contents to retrieve and render the stored segment of the received multimedia content. Device power consumption may be reduced by utilizing the local stored contents without access to the integrated systems' archives of broadcast program contents.

22 Claims, 5 Drawing Sheets

METHOD AND SYSTEM FOR INTEGRATED FM RECORDING

CROSS-REFERENCE TO RELATED APPLICATIONS/INCORPORATION BY REFERENCE

Not Applicable.

FIELD OF THE INVENTION

Certain embodiments of the invention relate to multimedia communication. More specifically, certain embodiments of the invention relate to a method and system for integrated FM recording.

BACKGROUND OF THE INVENTION

Radio broadcasting is an attractive medium for disseminating information and entertainment oriented programs from a central location to a very large segment of the public. One of the main attractions of radio broadcasting is that the cost of the receiver is very low and affordable to the public. As multimedia devices become more popular, they are rapidly being transformed into multi-functional devices capable of handling a plurality of different services. For example, in recent years, cell phones and multimedia players have incorporated an FM radio to allow multimedia device users to listen to live-broadcast FM radio stations. For example, the integrated FM radio may enable cell phone users to listen to the best mix of music, news, updates, talk shows, traffic and weather updates. A multimedia device such as a cell phone with an integrated FM radio may have a small digital display and a hard and/or soft buttons that may enable users of the cell phone choose their favorite FM radio stations. Users may also have the capability to preset a number of their favorite stations and enable their cell phone's hands-free speaker or use the cell phone's headset to listen to their favorite stations while traveling. Program reminders and alarms may be set so that listeners don't miss their favorite radio shows. In case of emergency, listeners may listen to the latest alerts which may be broadcast over the FM band.

The rapid increase in the availability and use of FM radio broadcasting applications may generate large amounts of audio data, which may be expensive to store and access via a multimedia device such as a cell phone.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

A system and/or method is provided for integrated FM recording, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for integrated FM recording. Various aspects of the invention may provide content-based multimedia contents recording, recorded content retrieval, and playback of desired or potentially relevant audio content via a single multimedia device. In this regard, a multimedia device may receive multimedia content along with information that may identify the received multimedia content via various integrated systems such as via an FM receiver integrated in the multimedia device. The received multimedia content information may be compared with a favorite content list and at least a portion/segment of the received multimedia content may be recorded accordingly based on the comparison. The favorite content list may be generated and updated based on the multimedia content and/or program selection data such as FM radio program selection data. The portion/segment of the received multimedia content may be automatically recognized and recorded by matching it with information in the favorite content list.

The recorded portion/segment of the received multimedia content may be stored within memory integrated with the multimedia device and/or within removable memory coupled to the multimedia device. In this regard, the multimedia device may be configured to have access to additional related stored multimedia contents to retrieve and render the stored portion/segment of the received multimedia content. In this regard, a user of the multimedia device may be provided with additional information on related stored contents. The multimedia content retrieval may enable recognition of desired contents without accessing, for example, the FM radio station archives of broadcast program content. This may reduce the multimedia device's total power consumption by shutting off the FM radio and utilizing the local stored content. This reduced power consumption may be particular useful in, for example, portable, battery-powered multimedia devices where battery power is a premium.

Figure 1:
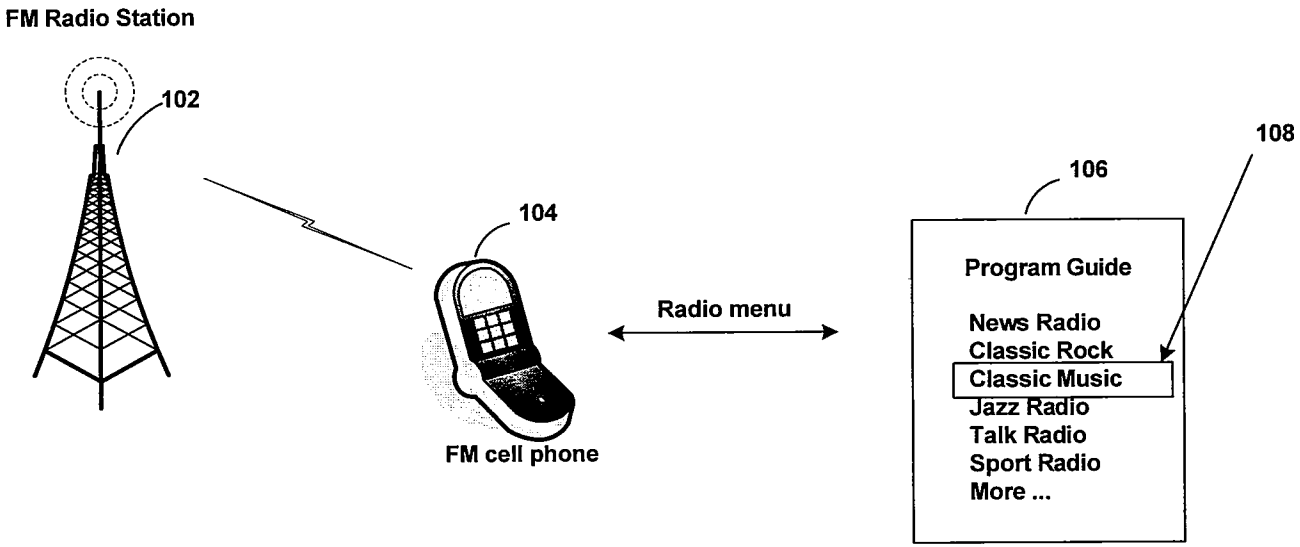
FIG. 1 is a block diagram of an exemplary FM radio station that communicates with a multimedia device with an integrated FM radio, in accordance with an embodiment of the invention.

FIG. 1 is a block diagram of an exemplary FM radio station that communicates with a multimedia device with integrated FM radio, in accordance with an embodiment of the invention. Referring to FIG. 1, there is shown a FM radio station 102, a FM enabled cell phone 104, a program guide of a radio menu 106, and program items such as "classic music".

The FM radio station 102 may comprise suitable logic, circuitry and/or code that may be allocated a single carrier frequency to broadcast a small subcarrier signal by applying a FM modulation centered at the single carrier frequency. The FM radio station 102 may enable communication of content, comprising FM audio, and/or FM data to multimedia devices such as the FM enabled cell phone 104. For example, real time financial information, news, sports, audio alerts and/or music may be sent to listeners over FM subcarrier frequencies by the FM radio station 102. Moreover, the FM radio station 102 may be enabled to broadcast radio data service (RDS) which allows the FM station 102 to transmit additional types of information via standard FM radio signals that may be received and displayed by local RDS-capable radios. For instance, when the FM enabled cell phone 104 may be equipped with a RDS tuner, the FM enabled cell phone 104 may display the title and artist or current song playing, local traffic information, an advertiser's phone number while playing a commercial.

The FM enabled cell phone 104 may comprise suitable logic, circuitry and/or code that may incorporate a FM radio to enable communication of content comprising FM audio and/or FM data. The FM enabled cell phone 104 may be enabled to receive FM transmission signals from the FM radio station 102. The user of the FM enabled cell phone 104 may then listen to the FM transmission via a listening device coupled to the FM enabled cell phone 104, a speaker, a headset, or an earphone, and may view text FM data through a device display when the FM enabled cell phone 104 may be RDS-capable, for example.

The program guide 106 of the radio menu may contain radio channel information used to listen to music or news via the FM radio on the FM enabled cell phone 104. A cursor 108 and/or one or more buttons may enable navigation of the program guide 106. For example, the cursor 108 and/or buttons may enable selection of an item from the program guide 106. In one embodiment of the invention, a favorite content list may be generated and stored within the FM enabled cell phone 104 or on a portable storage device such as a memory card. For each available radio station, certain FM radio broadcasting content may be recorded based on the favorite content list. In this regard, a content similarity analysis may be performed between the received FM radio broadcasting contents and those on the favorite content list to determine whether the received FM radio broadcasting contents should be recorded. Depending on the type of the received FM radio broadcasting contents, for example, for speech contents, the content similarity analysis may be exercised by extracting meaningful keywords and counting their frequency. In this regard, the user of the FM enabled cell phone 104 may specify domain exclusive keywords list to focus on some specific keywords or exclude some useless keywords. For music contents, a set of spectral features of corresponding audio signal may be used to identify a musical piece and its musical characteristics. The recorded FM radio content may be indexed by using, for example, station name, album name, artist name, composer, genre, and song name.

In operation, a user of the FM enabled cell phone 104 may generate FM station selection data via the FM enabled cell phone user interface and/or the program guide 106. The FM enabled cell phone 104 may be enabled to tune to an RF frequency based on the FM station selection specified by the FM enabled cell phone user interface. Based on the tuning, the FM enabled cell phone 104 may receive RF signals from the FM radio station 102. The content of the received FM signals may be evaluated by performing content similarity analysis via, for example, comparing a set of spectral features, between the received contents of the FM signals and those of the favorite content list. The recognized contents of the FM signals may be recorded by the FM enabled cell phone 104.

The recorded content may be indexed and stored in a memory of the FM enabled cell phone 104. The content indexing may be enabled to provide information on the contents such as, for example, station name, artist name, and song name. This information may be determined from transmitted FM data such as RDS information. The recorded contents may be played back when desired by users, or may be used to retrieve the contents for a better stereo performance. In this regard, the recorded contents may be retrieved by matching one or more characteristics to the previously stored recorded contents. Meanwhile, the previously stored recorded contents may be refined or updated by the newly recorded contents depending on the quality of the newly recorded contents such as the associated SNR value, for example. Users may enjoy better stereo experiences accordingly by playing back high quality stored contents. The FM enabled cell phone 104 may be configured to allow additional related stored recorded contents to be accessed for users. In this regard, users may receive additional information such as related contents stored on the FM enabled cell phone 104 for an identified recording content.

Figure 2:
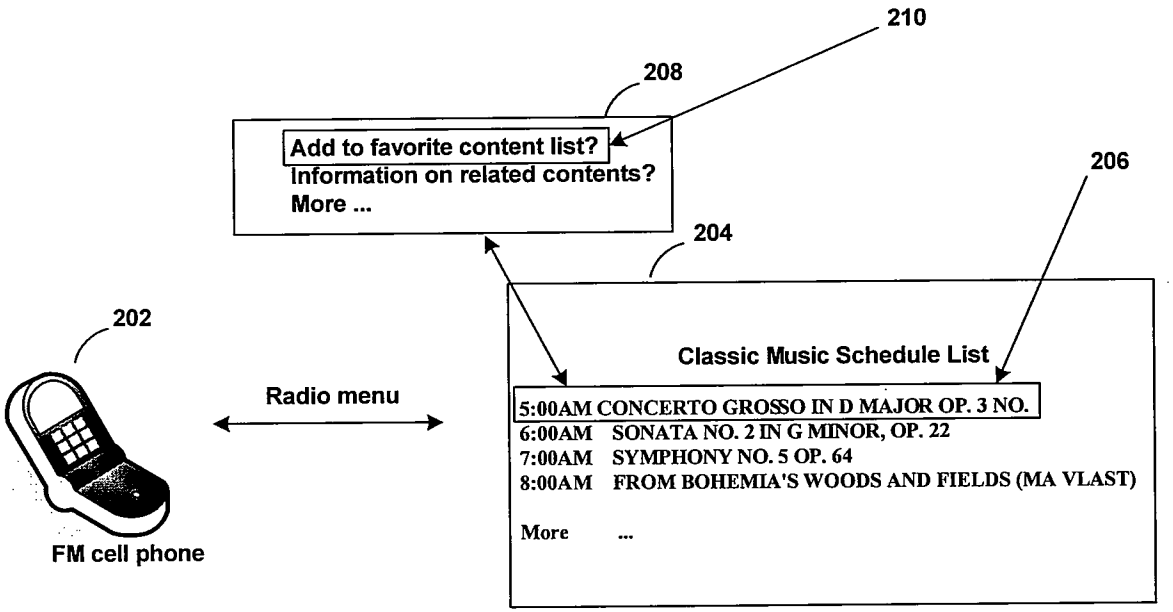
FIG. 2 is a diagram that illustrates an exemplary FM radio station that communicates with a multimedia device with an integrated FM radio, in accordance with an embodiment of the invention.

FIG. 2 is a diagram that illustrates an exemplary FM radio station that communicates with a multimedia device with an integrated FM radio, in accordance with an embodiment of the invention. Referring to FIG. 2, there is shown a FM enabled cell phone 202, a classic music schedule list 204 of the FM radio station 102, and a sub-menu 208. The classic music schedule list 204 may comprise suitable information such as, the time of day and the name of the show, for example, the item pointed by a cursor 206. The sub-menu 208 may comprise a list of various options, which may, for example, enable a user to add the selected show to a favorite content list and/or enable the user to view information related to current selection.

The FM enabled cell phone 202 may recognize that the user has selected the item "Classic Music." In response to the selection, the FM enabled cell phone 202 may display the classic music schedule list 204. The sub-menu 208 may be presented by selecting a specific music program such as the one pointed to by the cursor 206. In this regard, the sub-menu 208 may provide the user with various options to add corresponding contents of the selected music program to a favorite content list as pointed by a cursor 210, and/or further to view information on those related contents stored on the FM enabled cell phone 202. In this regard, the favorite content list may be generated and/or updated based on the statistics of user FM radio station data such as the selection pointed by the cursor 210. In order to determine whether to record the contents of the selected music show, a content similarity analysis may be performed between the contents of the selected music show and those of the favorite content list. The similarity analysis may be a subjective matter. For example, a text similarity may be measured by counting the number of words in common, while an audio similarity may be achieved by taking a perceptual approach using measures derived from the audio that may reflect perceptual characteristics such as spectral features, pitch, and loudness. There may be instances when a specific set of psychoacoustic features may be used for audio similarity analysis. In instances where, for example, the contents of the selected music show may match the favorite content list, the contents may then be identified to be recorded. In this regard, users may be provided, as shown in the sub-menu 208, with related contents stored on the FM enabled cell phone 202 for the identified recording contents. In this regard, information about the related contents may be displayed in the main menu of the classic music schedule list 204 together with the currently identified content. The favorite content list may allow for recognition of wanted contents without access into the FM radio station 102 archives. This may reduce the cell phone's total power consumption by shutting off the FM radio and utilizing the local recognized contents. This reduction in power consumption may be particularly useful in, for example, portable, battery-powered multimedia devices, such as the FM enabled cell phone 202.

Figure 3:
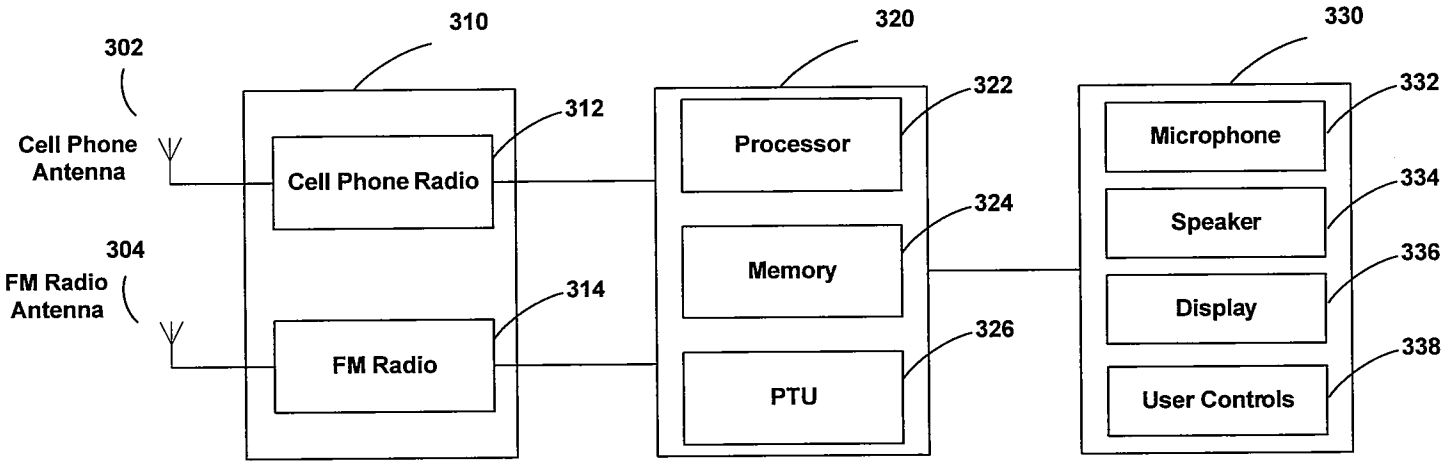
FIG. 3 is a block diagram of an exemplary mobile station with integrated FM radio, in accordance with an embodiment of the invention.

FIG. 3 is a block diagram of an exemplary mobile station with integrated FM radio, in accordance with an embodiment of the invention. Referring to FIG. 3, there is shown a mobile station may comprise a cell phone antenna 302, a FM radio antenna 304, a radio portion 310, a processing portion 320, and a user interface portion 330.

The cell phone antenna 302 and the FM radio antenna 304 may comprise suitable logic, circuitry, and/or code that may be enabled to receive RF signals from base stations and a FM radio station, separately.

The radio portion 310 may comprise a plurality of integrated radios. For example, a cell radio 312 that may support cellular communications and an FM radio 314 that may support FM communications.

The processing portion 320 may comprise at least one processor 322, a memory 324, and a peripheral transport unit (PTU) 326. The processor 322 may comprise suitable logic, circuitry, and/or code that may enable processing of data received from the radio portion 310. In this regard, each of the integrated radios may communicate with the processing portion 320. In some instances, the integrated radios may communicate with the processing portion 320 via a common bus, for example.

The memory 324 may comprise suitable logic, circuitry, and/or code that enable storage of data that may be utilized by the processor 322. In this regard, the memory 324 may store at least a portion of the data received by at least one of the integrated radios in the radio portion 310. The favorite content list, which may be generated based on user FM program selection statistics, may be stored in the memory 324 as a part of FM program preferences. Other user settings such as, but not limited to, times at which to automatically record various FM programs may be stored in memory 324 as a part of FM program recordings. Moreover, the memory 324 may store at least a portion of the data that may be transmitted by at least one of the integrated radios in the radio portion 310. The memory 324 of the FM enabled cell phone 202 may comprise RAM, ROM, low latency nonvolatile memory such as flash memory and/or other suitable electronic data storage.

The PTU 326 may comprise suitable logic, circuitry, and/or code that may enable communication via a plurality of interfaces. In accordance with an exemplary embodiment of the invention, the PTU 326 may support an external memory interface, a universal asynchronous receiver transmitter (UART), and/or an audio interface.

The user interface portion 330 of the cellular phone 202 may comprise a plurality of associated components such as a microphone 332, a speaker 334, a display 336, and a user control 338.

The microphone 332 may comprise suitable logic, circuitry, and/or code that generate audio prompts to provide audio indicators that help a user navigate through the features of the cellular phone 202. The speaker 334 may comprise suitable logic, circuitry, and/or code that enable a user to hear an audio file being played by the FM enabled cell phone 202.

The display 336 may comprise suitable logic, circuitry, and/or code that may enable presentation or display graphics and/or text. In this regard, the corresponding character data and image data may be the received communication data from a remote device or inputted by the user. The user control 338 may comprise suitable logic, circuitry, and/or code that receive various instructions and specifications from a user, and output the instructions and specifications to the processing portion 320. For example, the user control 338 may receive FM station selection data from the user and pass it to the processor 322. In this regard, the user control 338 may further receive, from the user, an instruction to add a selected FM program to a user favorite content list, and output the instruction to the processing portion 320.

In operation, the user control 338 may receive instructions for selecting a FM radio station. The instruction may be received by activation of a soft or hard button, textual input and/or and audio input such as a voice input received via the microphone 332. The received FM radio station selection data may be stored in the memory 324 for the processor 322 to control and/or manage the operations of a FM station selection.

The processor 322 may generate signals to tune the FM radio 314 to a certain carrier frequency based on the received FM radio station selection data to determine whether there may be a station at that carrier frequency. When a station is found, the processor 322 may configure a path for FM radio signals received over that carrier frequency to be processed in the processor 322. The processor 322 may output the received FM signals to user via the speaker 334. Moreover, the processor 322 may forward the processed FM information such as the station name, artist name and song name for example, in a suitable format suitable for display on the display 336 of the mobile station. The received contents of the FM signals may be selectively recorded based on a favorite content list and saved in the memory 324. In this regard, the recorded contents may be used to improve the quality of the corresponding similar contents on the favorite content list for a better stereo performance and may be indexed by various ways, for example, using the station name, artist name, for example, to provide some insight into the content of a received audio file, and perhaps ways of using it for playback list sorting. The favorite content list may be generated and updated based on the FM program selection statistics. The user may play back the recorded contents anytime they want.

Figure 4:
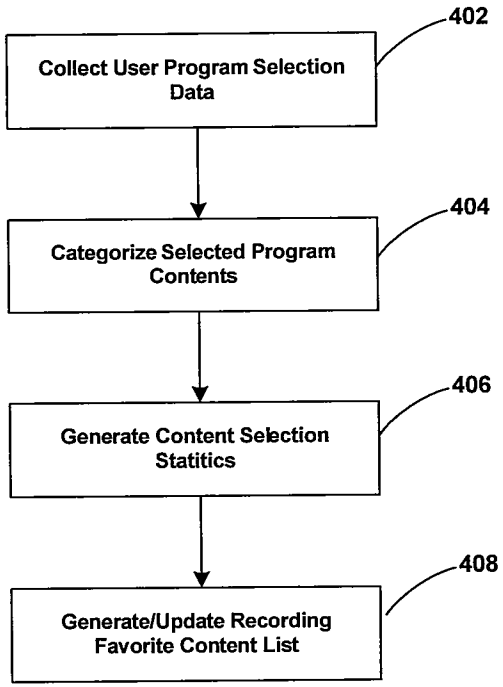
FIG. 4 is a flow chart that illustrates exemplary steps for a favorite content list generation, in accordance with an embodiment of the invention.

FIG. 4 is a flow chart that illustrates exemplary steps for a favorite content list generation, in accordance with an embodiment of the invention. Referring to FIG. 4, the exemplary steps begin in step 402, where user program selection data may be collected via the program guide of a radio menu 106 and the exemplary classic music schedule list 204 and saved in the memory 324. In step 404, the segment of contents of the selected program may be categorized such as, for example, sport, music, artist name, or radio station names. In step 406, content selection statistics may be generated in terms of the segment of contents of the selected program. In step 408, a favorite content list may be generated and/or updated via sub-menu 208 and the statistics generated in step 406.

Figure 5:
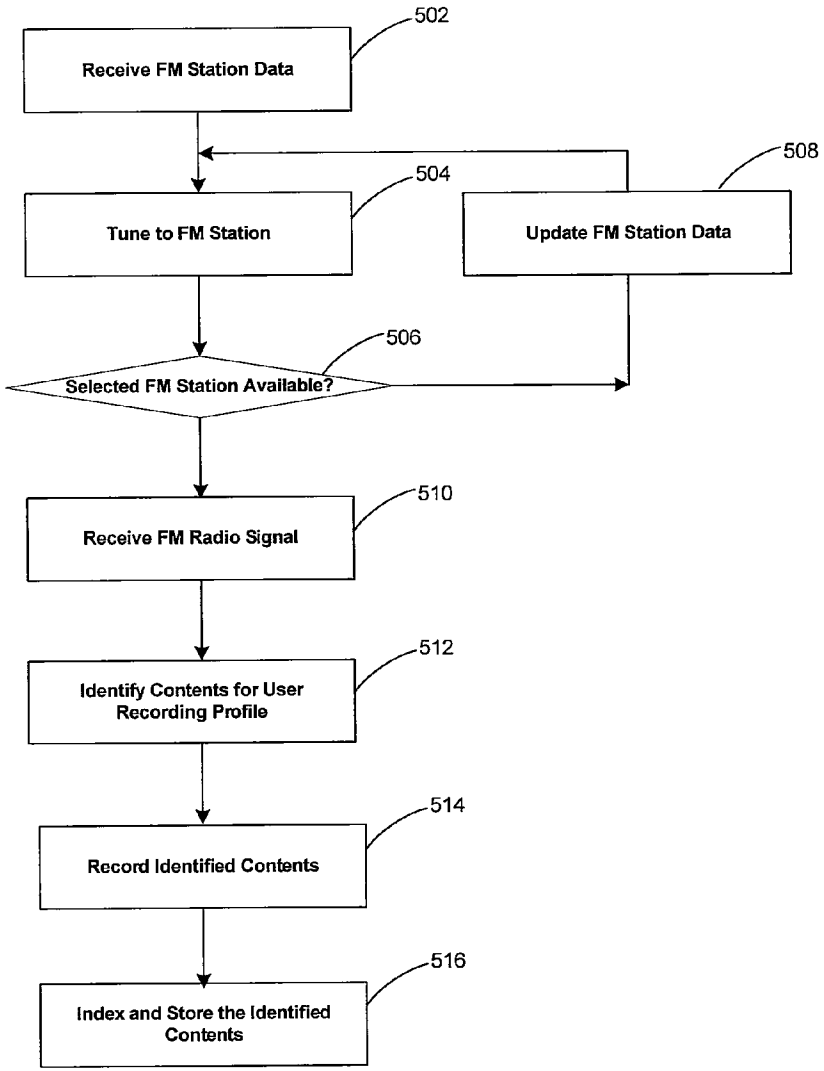
FIG. 5 is a flow chart that illustrates exemplary steps for integrated FM recording, in accordance with an embodiment of the invention.

FIG. 5 is a flow chart that illustrates exemplary steps for integrated FM recording, in accordance with an embodiment of the invention. Referring to FIG. 5, the exemplary steps begin in step 502, where a multimedia device, for example, a FM enabled cell phone 104, may enable receiving of FM station data through the user controls 328 or the microphone 332 from the user. In step 504, the processing may enable tuning of the FM radio 314 to a carrier frequency based on the FM station data. In step 506, it may be determined whether the FM radio station is available. In instances where a selected FM radio station may be available, in step 510, the FM radio 314 may receive FM radio signals over the corresponding carrier frequency. In step 512, the contents of the received FM radio signal may be identified by, for example, analyzing content similarity per the favorite content list, to be recorded. In step 514, the identified contents may be recorded. In step 512, the recorded contents may be indexed by, for example, the FM radio station name, artist name, and/or song name, and stored in the memory 324. In step 506, in instances where a selected FM radio station may not be available, in step 508, the FM station selection data may be adjusted and then go to step 504.

Aspects of a method and system for integrated FM recording are provided. A multimedia device such as, for example, the FM enabled cell phone 202, with the integrated FM radio 314 may be enabled to provide content-based multimedia contents recording, recorded content retrieval, and playback of desired or potentially relevant audio content. The multimedia contents may be from, for example, FM radio and/or Internet radio, and may be accessed via the FM radio and/or the Internet radio, respectively. In this regard, the multimedia device such as the FM enabled cell phone 202 may receive multimedia content along with information identifying the received multimedia content via various systems such as the integrated FM radio 314. In this regard, the received multimedia content information may be compared with the favorite content list stored in the FM enabled cell phone 202 and a segment of the received multimedia content may be recorded selectively based on the comparison. In this regard, the favorite content list may be generated and updated based on the multimedia content and/or program selection data such as FM radio program selection data inputted through user interface portion 330 from users.

The segment of the received multimedia content may be automatically recognized and recorded by matching it with information in the favorite content list. The recorded segment of the received multimedia content may be stored within the memory 324 integrated with the FM enabled cell phone 202 and/or within a removable memory coupled to the FM enabled cell phone 202. In this regard, the FM enabled cell phone 202 may be configured to access additional related stored multimedia contents to retrieve and render the stored segment of the received multimedia content such that additional information on related stored contents may be provided to users of the FM enabled cell phone 202. Some desired contents may be recognized without the need to access, for example, the FM radio station archives of broadcast program contents. Under such circumstances, the total power consumption of the FM enabled cell phone 202 may be reduced by shutting off the FM radio 314 and utilizing the local stored contents.

It is to be understood that the multimedia device such as, for example, the FM enabled cell phone 202 may have access to multimedia contents of various types of broadcasting services such as, for example, the Internet radio broadcasting. Further, the multimedia device may access the multimedia contents via various systems such as, for example, satellite, DVB-H, WiMAX, and cellular.

Another embodiment of the invention may provide a machine-readable storage, having stored thereon, a computer program having at least one code section executable by a machine, thereby causing the machine to perform the steps as described herein for.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method, comprising:

receiving an audio content item by a broadcast radio receiver along with information that identifies said audio content item;

comparing said information that identifies said audio content item with a favorite content list to identify similar content;

recording said audio content item based at least in part on said comparison;

determining whether a current audio signal received by said broadcast radio receiver meets a minimum signal quality threshold; and playing said recorded audio content item in place of said current audio signal based at least in part on said information that identifies said audio content item in response to determining that said current audio signal does not meet said minimum signal quality threshold.

2. The method according to claim 1, wherein said broadcast radio receiver corresponds to a frequency modulation (FM) radio receiver.

3. The method according to claim 2, comprising generating said favorite content list based at least in part on FM radio program selection data.

4. The method according to claim 1, comprising updating said favorite content list based at least in part on said information that identifies said audio content item.

5. The method according to claim 1, comprising recording said audio content item when said information that identifies said audio content item matches information that is within said favorite content list.

6. The method according to claim 1, further comprising disabling said broadcast radio receiver while playing said recorded audio content item.

7. A system, comprising:

one or more circuits configured to receive an audio content item along with information that identifies said audio content item;

said one or more circuits configured to compare said information that identifies said audio content item with a favorite content list to identify similar content;

said one or more circuits configured to record said audio content item based at least in part on said comparison;

said one or more circuits configured to determine whether a current audio signal received by said one or more circuits meets a minimum signal quality threshold; and said one or more circuits configured to play said recorded audio content item in place of said current audio signal based at least in part on said information that identifies said audio content item in response to said current audio signal not meeting said minimum signal quality threshold.

8. The system according to claim 7, wherein said audio content item is received via a frequency modulation (FM) radio.

9. The system according to claim 8, wherein said one or more circuits are configured to generate said favorite content list based at least in part on FM radio program selection data.

10. The system according to claim 7, wherein said one or more circuits are configured to update said favorite content list based at least in part on said information that identifies said audio content item.

11. The system according to claim 7, wherein said one or more circuits are configured to record said audio content item when said information that identifies said audio content item matches information that is within said favorite content list.

12. The system according to claim 7, wherein said one or more circuits are configured to shut off circuitry used to receive said current audio signal while playing said recorded audio content item.

13. The method of claim 1, further comprising:

determining whether said current audio signal is associated with a greater signal quality than said recorded audio content item; and updating said recorded audio content item with another audio content item obtained from said current audio signal in response to determining that said current audio signal is associated with said greater signal quality than said recorded audio content item.

14. The method of claim 1, further comprising:

obtaining information that identifies another audio content item present in said current audio signal;

determining whether said recorded audio content item matches at least one characteristic of said other audio content item based at least in part on said information that identifies said other audio content item and said information that identifies said audio content item; and wherein said recorded audio content item matches said at least one characteristic of said other audio content item when said recorded audio content item is played.

15. The method of claim 1, further comprising obtaining said information that identifies said audio content item from radio data service (RDS) data received by said broadcast radio receiver.

16. The system of claim 7, wherein said one or more circuits are further configured to:

determine whether said current audio signal is associated with a greater signal quality than said recorded audio content item; and update said recorded audio content item with another audio content item obtained from said current audio signal in response to determining that said current audio signal is associated with said greater signal quality than said recorded audio content item.

17. The system of claim 7, wherein said one or more circuits are further configured to compare a first signal quality metric associated with said recorded audio content item with a second signal quality metric associated with said current audio signal.

18. The system of claim 7, wherein said one or more circuits are further configured to:

obtain information that identifies another audio content item present in said current audio signal;

determine whether said recorded audio content item matches at least one characteristic of said other audio content item based at least in part on said information that identifies said other audio content item and said information that identifies said audio content item; and wherein said recorded audio content item matches said at least one characteristic of said other audio content item when said recorded audio content item is played.

19. The system of claim 7, wherein said one or more circuits are further configured to obtain said information that identifies said audio content item from radio data service (RDS) data.

20. A system, comprising:

circuitry configured to:

receive an audio content item by a broadcast radio receiver along with information that identifies said audio content item;

record said audio content item;

determine whether a current audio signal received by said broadcast radio receiver meets a minimum signal quality threshold; and play said recorded audio content item in place of said current audio signal based at least in part on said information that identifies said audio content item in response to determining that said current audio signal does not meet said minimum signal quality threshold.

21. The system of claim 20, wherein said circuitry further configured to:

determine whether said current audio signal is associated with a greater signal quality than said recorded audio content item; and update said recorded audio content item with another audio content item obtained from said current audio signal in response to determining that said current audio signal is associated with said greater signal quality than said recorded audio content item.

22. The system of claim 20, wherein said circuitry is further configured to:

obtain information that identifies another audio content item present in said current audio signal;

determine whether said recorded audio content item matches at least one characteristic of said other audio content item based at least in part on said information that identifies said other audio content item and said information that identifies said audio content item; and wherein said recorded audio content item matches said at least one characteristic of said other audio content item when said recorded audio content item is played.

* * * * *